US005847380A

United States Patent [19]

Tachino et al.

[11] Patent Number: 5,847,380

[45] Date of Patent: Dec. 8, 1998

[54] SIDE-ON TYPE PHOTOMULTIPLIER COMPRISING AN ENVELOPE HAVING AN OPENING, A LENS ELEMENT, AND A LENS POSITIONING STRUCTURE

[75] Inventors: Masumi Tachino; Hidehiro Kume; Suenori Kimura; Takashi Goto, all of Hamamatsu, Japan

[73] Assignee: Hamamatsu Photonics K.K., Hamamatsu, Japan

[21] Appl. No.: 924,263

[22] Filed: Sep. 5, 1997

[30] Foreign Application Priority Data

Sep. 6, 1996 [JP] Japan ..... 8-237020

[51] Int. Cl.[6] ..... H01J 40/16

[52] U.S. Cl. ..... 250/207; 313/524; 313/532

[58] Field of Search ..... 250/207, 214 VT, 250/214 R, 239; 313/523, 524, 531, 532, 533, 534, 535, 536, 537, 538, 539, 540, 542, 544

[56] References Cited

U.S. PATENT DOCUMENTS

| | | | |
|---|---|---|---|
| 2,715,195 | 8/1955 | Friedman | 313/537 |
| 2,739,245 | 3/1956 | Reed | 313/524 |
| 2,821,637 | 1/1958 | Roberts et al. | 313/524 |
| 3,567,948 | 3/1971 | Oke et al. . | |
| 3,668,388 | 6/1972 | Fisher et al. | 313/533 |
| 3,672,992 | 6/1972 | Schaefer | 313/542 |
| 4,180,725 | 12/1979 | Abraham et al. | 313/533 |
| 4,912,315 | 3/1990 | Arakawa et al. | 250/207 |
| 4,959,545 | 9/1990 | Arakawa et al. | 250/207 |
| 5,023,511 | 6/1991 | Phillips | 313/524 |
| 5,210,403 | 5/1993 | Nakamura et al. | 250/207 |
| 5,420,476 | 5/1995 | Nakamura et al. | 250/207 |

FOREIGN PATENT DOCUMENTS

| | | |
|---|---|---|
| 2-022334 | 5/1990 | Japan . |
| 6-011572 | 1/1994 | Japan . |
| 6-109635 | 4/1995 | Japan . |

*Primary Examiner*—Edward P. Westin
*Assistant Examiner*—John R. Lee
*Attorney, Agent, or Firm*—Pillsbury Madison & Sutro LLP

[57] ABSTRACT

The present invention relates to a versatile side-on type photomultiplier comprising a structure for improving the uniformity in light receiving sensitivity. This photomultiplier comprises a positioning structure for precisely positioning, with respect to the light receiving surface of a photocathode, a lens element which guides light to be detected to a photocathode and constitutes a part of an envelope accommodating the photocathode. The precisely positioned lens element guides the light to be detected into, of the light receiving surface of the photocathode, an effective region where the light receiving sensitivity is high, thereby restraining the light to be detected from reaching the outside of the effective region.

7 Claims, 8 Drawing Sheets

SIDE-ON TYPE PHOTOMULTIPLIER COMPRISING AN ENVELOPE HAVING AN OPENING, A LENS ELEMENT, AND A LENS POSITIONING STRUCTURE

BACKGROUND OF THE INVENTION

FIELD OF THE INVENTION

The present invention relates to a light detecting apparatus and, in particular, to a so-called side-on type photomultiplier having a reflection type photocathode which is inclined with respect to the direction of incidence of light to be detected.

RELATED BACKGROUND ART

For instance, Japanese Patent Publication No. 2-22334 discloses an example of side-on type photomultipliers. In the photomultiplier disclosed in this publication, light passing through a slit is guided through an imaging lens onto a reflection type photocathode. Such a configuration shortens the electron transit time between the photocathode and the dynode of the first stage, thereby reducing the fluctuation in electron transit time.

SUMMARY OF THE INVENTION

Having studied the conventional side-on type photomultiplier having the above-mentioned configuration, the inventors have found the following problems. Namely, in the conventional photomultiplier, since the imaging lens is disposed as a member separated from the photomultiplier, it is necessary for the imaging lens and the photocathode to be precisely aligned, in terms of optical axis, with respect to the light to be detected. In particular, this optical axis alignment is necessary after an operation for replacing the photomultiplier. Also, an additional apparatus is necessary so as to be utilized for the optical axis alignment of the imaging lens with the photocathode, thus affecting usability. Further, since a part of light to be detected which should reach the photocathode is eliminated by a slit plate, the conventional photomultiplier may not be suitable for such a use as measurement of weak light, thus lacking in versatility (restricting its use).

In order to overcome the above-mentioned problems, it is an object of the present invention to provide a side-on type photomultiplier comprising a structure excellent in versatility and a structure for improving the uniformity in its light receiving sensitivity.

The side-on type photomultiplier according to the present invention guides light to be detected to a reflection type photocathode provided within a sealed envelope; cascade-multiplies by an electron multiplier comprising a plurality of stages of dynodes, photoelectrons emitted from the reflection type photocathode; and collects thus multiplied secondary electron at an anode as output electric signals. Basically, the side-on type photomultiplier according to the present invention comprises, at least, an envelope having an opening for transmitting therethrough light to be detected; a photocathode, which has a light receiving surface with a predetermined area, for emitting a photoelectron in response to the light to be detected reaching there after being transmitted through the opening of the envelope; and a lens element for guiding onto a predetermined region in the photocathode the light to be detected. Here, the photocathode is accommodated in the envelope and is supported by an electrode member while being inclined with respect to the direction of incidence of the light to be detected. Also, the lens element covers the opening of the envelope so as to constitute a part of the envelope, while functioning to improve the uniformity in the light receiving sensitivity of the photomultiplier.

In particular, the side-on type photomultiplier according to the present invention comprises a positioning structure for precisely defining the installed position of the lens element with respect to the photocathode. This positioning structure has a supporting section which is provided on the outer peripheral surface of the envelope so as to surround the opening of the envelope, while extending from the outer peripheral surface of the envelope along a direction opposite to the direction of incidence of the light to be detected. This supporting section includes a reference surface for supporting the lens element and defining the distance between the lens element and the photocathode.

As the lens element, a condenser lens having a positive refracting power can be employed. The condenser lens restricts the area of the light incident region on the photocathode, where the light to be detected should reach, so as to make it smaller than the area of the light receiving surface of the photocathode. Also, the condenser lens has, at least, a flat surface facing the reference surface of the supporting section in the positioning structure.

Preferably, the condenser lens includes a cylindrical lens having a curved light entrance surface. When such a cylindrical lens is employed, the light to be detected can be collected, in a slit form, within the effective region on the photocathode, thus elongating the form of the collected light on the photocathode in its longitudinal direction so as to match the long form of the photocathode. Accordingly, the form of the area of the photocathode on which the collected light reaches can match the long form of the dynode in each stage, thus allowing the electron multiplying region of each dynode to be utilized efficiently. Also, it becomes unnecessary to perform an operation for inserting a slit plate between an object (light emitting source of the light to be detected) and the photomultiplier, and the axial alignment of the slit in the slit plate with the photocathode. Here, "cylindrical lens" refers to a lens having at least one surface formed like a part of a cylinder and yielding astigmatism such that a point of light extends into a line.

Also, the above-mentioned condenser lens may include a hemispherical lens having a spherically-curved light entrance surface. Since the light to be detected can be collected onto the photocathode in a spot form, such a configuration is effective for detecting weak light in particular.

In addition, the condenser lens is supported by the positioning structure disposed so as to surround the opening of the envelope. When the condenser lens is thermally fused, by means of frit glass or the like, with the supporting section (having the reference surface for the condenser lens) of the positioning structure, it becomes easy to perform an operation for precisely attaching the condenser lens to a desired position in the envelope. Also, the condenser lens and the body of the envelope may be made of materials different from each other.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, preferred embodiments of the side-on type photomultiplier according to the present invention will be explained in detail with reference to FIGS. 1 to 10.

Figure 1:
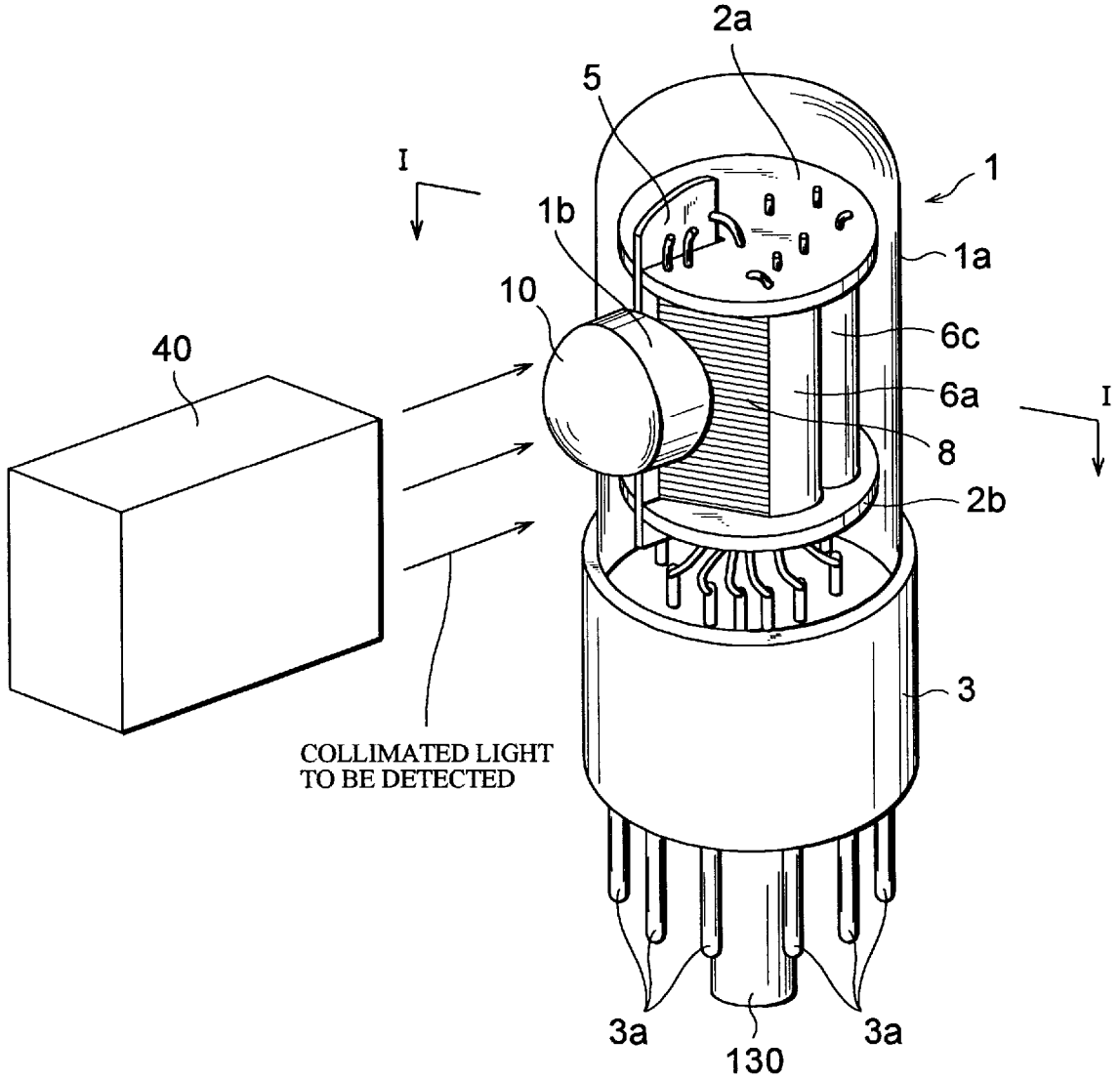
FIG. 1 is a perspective view showing an arrangement of a first embodiment of the side-on type photomultiplier according to the present invention and a light detecting apparatus to which the first embodiment is applied.

FIG. 1 is a perspective view showing an arrangement of a first embodiment of the side-on type photomultiplier according to the present invention and a light detecting apparatus to which the first embodiment is applied. In this drawing, the side-on type photomultiplier includes a sealed envelope 1 transparent to light to be detected. This sealed envelope 1 is formed as a transparent cylinder whose upper and lower ends are closed, while comprising borosilicate glass, UV glass, silica glass, or the like. In the sealed envelope 1, insulator substrates 2*a* and 2*b* made of ceramics or the like are respectively disposed at upper and lower portions thereof, such that various kinds of electrodes are supported as being held between a pair of the insulator substrates 2*a* and 2*b*. Secured to the bottom portion of the sealed envelope 1 is a pin base 3 made of a resin. This pin base 3 is provided with a plurality of pin terminals 3*a*, by which the various kinds of electrodes are lead to the outside.

Figure 2:
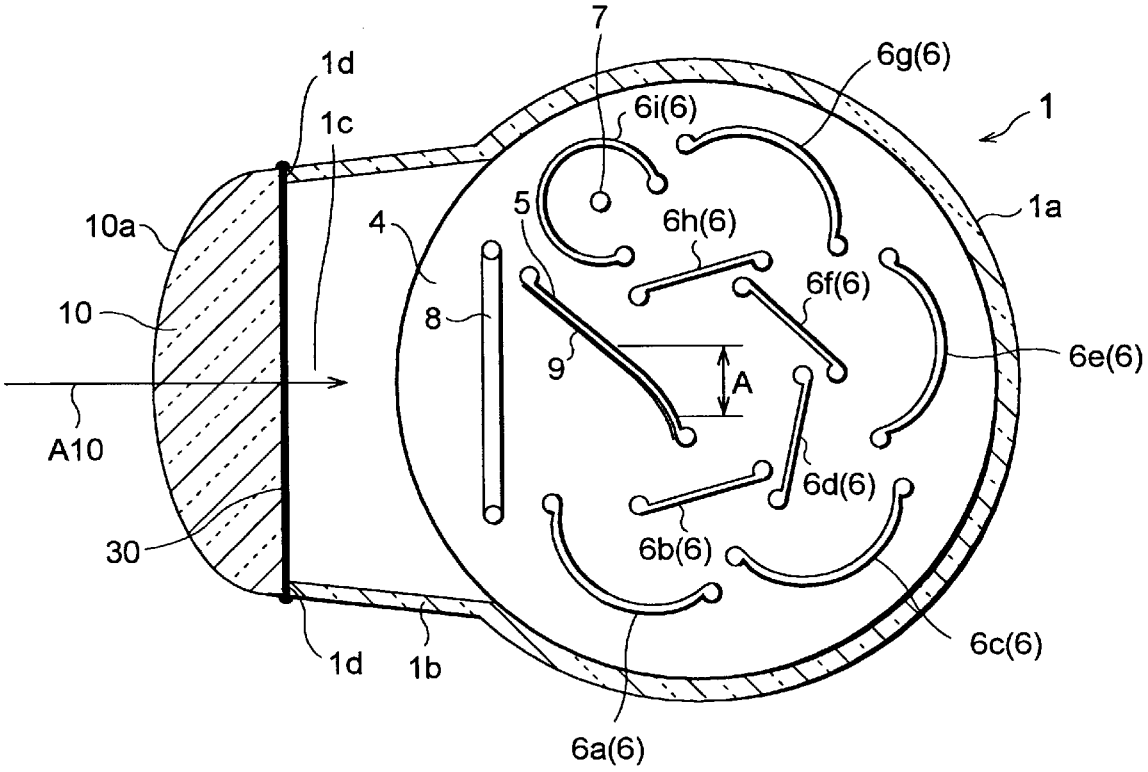
FIG. 2 is a sectional view of the first embodiment taken along line I—I in FIG. 1.

As shown in FIGS. 1 and 2, supported by a pair of the insulator substrates 2*a* and 2*b* therebetween are a reflection type photocathode 9 supported by an electrode plate 5 so as to be inclined with respect to the direction of incidence of the light to be detected (collimated light) that is indicated by depicted arrow A10; an electron multiplier 6 comprising a plurality of stages of dynodes 6*a* to 6*i* for cascade-multiplying photoelectrons emitted from the photocathode 9; and an anode 7 for collecting thus multiplied electron (secondary electron) as output signals. Further disposed between an entrance opening 4 of the envelope 1 and the photocathode 9 is a grid electrode 8 for securely guiding the photoelectron emitted from the photocathode 9 into the dynode 6*a* of the first stage. This grid electrode 8 is set to the same potential as the photocathode 9. Also, the photocathode 9 is formed on the electrode plate 5 and faces the entrance opening 4 of the envelope 1.

Figure 4:
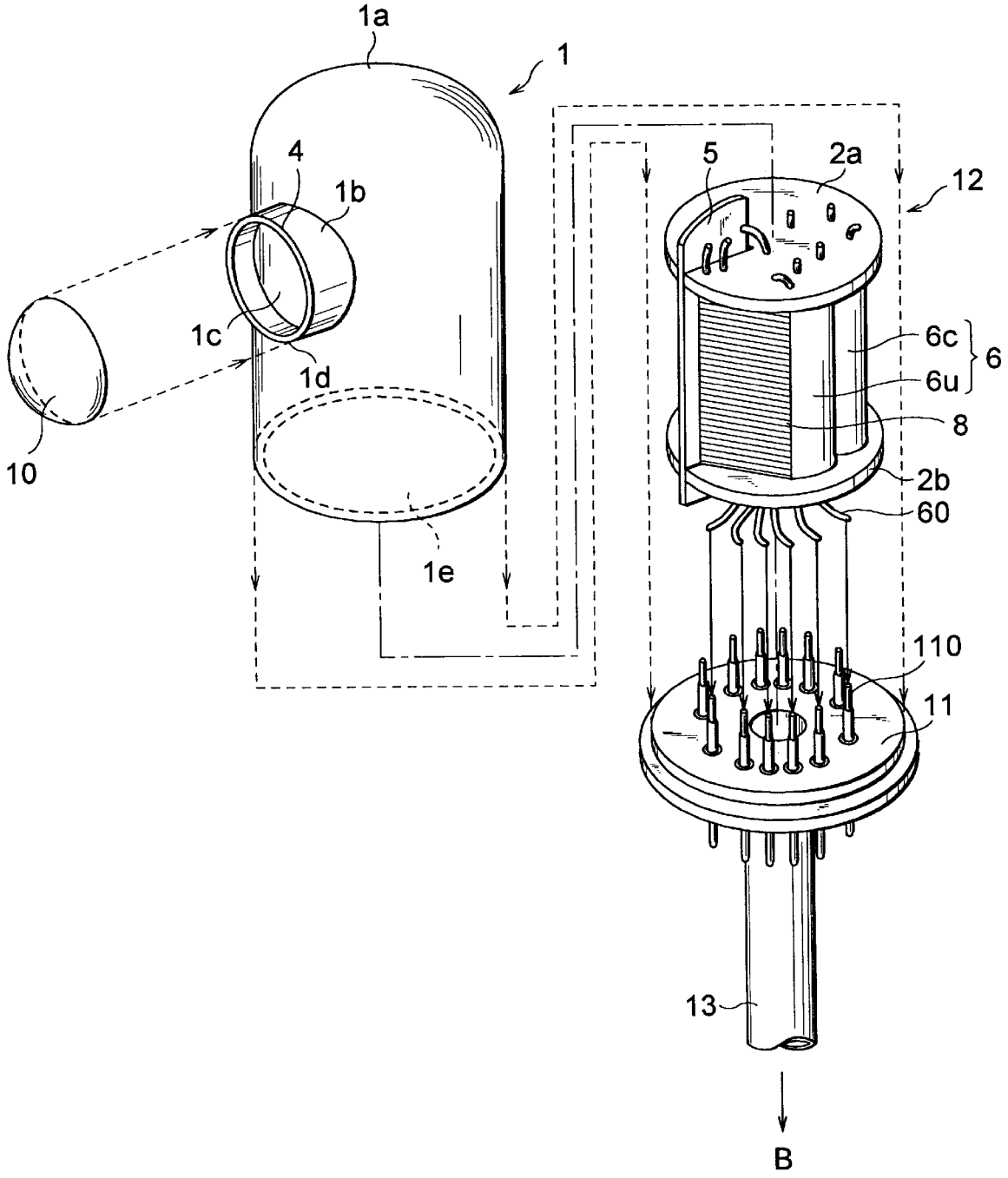
FIG. 4 is a (first) view showing an assembling step of the side-on type photomultiplier according to the present invention.

Before assembling, as shown in FIG. 4, the envelope 1 includes a transparent cylindrical bulb body 1*a* having a closed upper end and an open lower end. This bulb body 1*a* comprises any of various kinds of glass such as borosilicate glass, UV glass, and silica glass. A pipe-shaped supporting section 1*b* (positioning structure) is integrally formed with the entrance opening 4 in the bulb body 1*a*, thereby defining a space 1*c* through which the light to be detected passes. A hemispherical lens 10, as a condenser lens, is secured to a reference surface 1*d* of the supporting section 1*b* so as to cover the entire opening 1*c* of the bulb body 1*a*. The hemispherical lens 10 is made of a material different from that of the bulb body 1*a*. For example, when the bulb body 1*a* is made of borosilicate glass which is hard to transmit UV rays therethrough, UV-transparent glass having a characteristic different from that of borosilicate glass is employed as the hemispherical lens 10. The hemispherical lens 10 is thermally fused, by means of frit glass or the like, with the reference surface 1d of the supporting section 1*b*, so as to be integrated with the bulb body 1*a*, thus constituting a part of the bulb body 1*a*. Here, the material of the bulb body 1*a* and that of the hemispherical lens 10 may be of any combination and be changed appropriately. Also, the hemispherical lens 10 may be made of a plastic material. In this case, the hemispherical lens 10 is secured to the bulb body 1*a* by means of an epoxy resin type adhesive (e.g., product No. 1565 manufactured by Cemedine Co., Ltd.).

Figure 3:
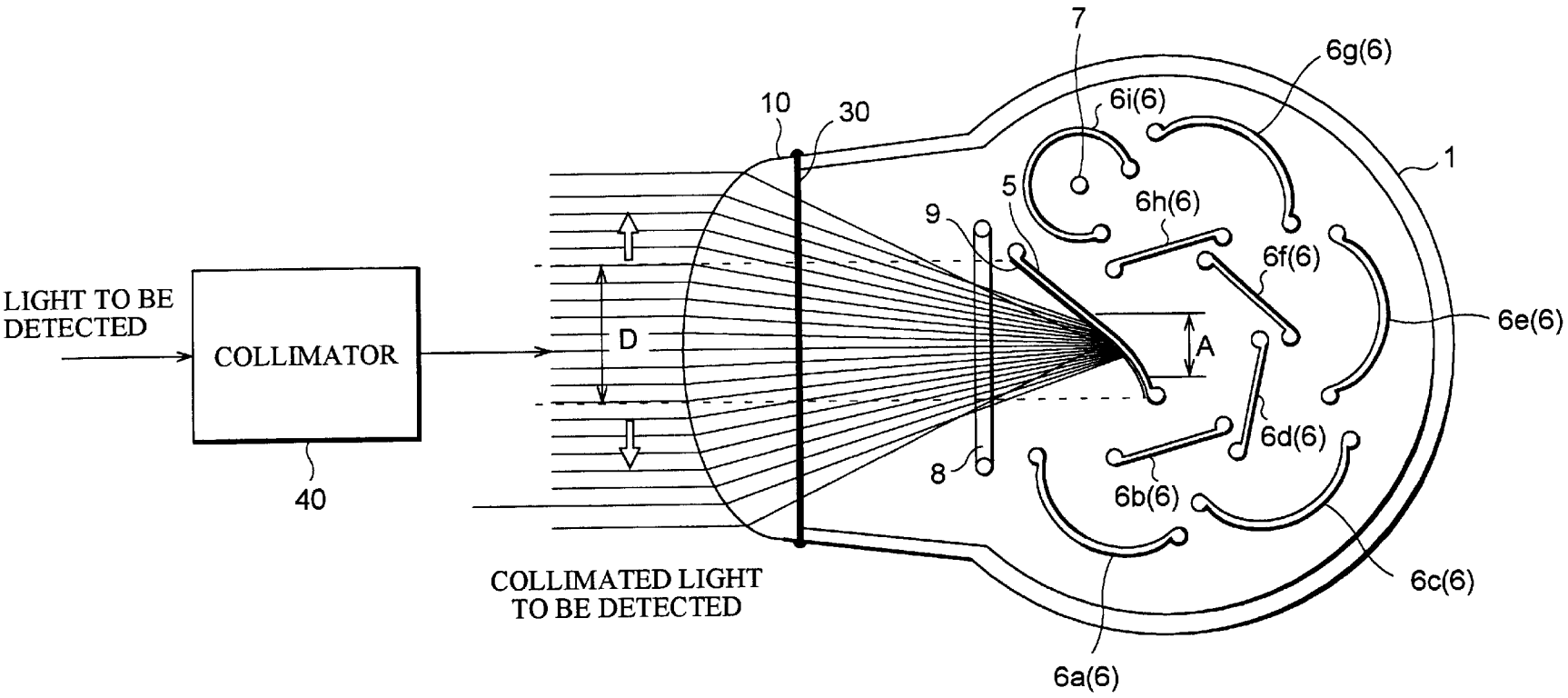
FIG. 3 is a view for explaining a function of a lens element employed in the side-on type photomultiplier and light detecting apparatus according to the present invention, which corresponds to the sectional view of the first embodiment taken along line I—I in FIG. 1.

As shown in FIGS. 2 and 3, the radius of curvature of a spherically-curved light entrance surface 10*a* disposed on the front side of the hemispherical lens 10 is selected such that the light to be detected incident on the hemispherical lens 10 substantially forms a focal point in an effective region A of the photocathode 9. The surface opposite to the entrance surface 10*a* (i.e., surface facing the photocathode 9) is made flat so as to be securely attached to the reference surface 1*d* of the supporting section 1*b*. When the hemispherical lens 10 is utilized, the light to be detected can be collected into a spot formed on the effective region A of the photocathode 9. Selected as the location of this spot-like collected light portion is the center part on the effective region A where the anode sensitivity in the length directions is particularly high. When the light to be detected is collected into a spot form on the photocathode 9, very weak light to be measured can securely be detected.

In the following, assembling steps of the photomultiplier will be explained with reference to FIGS. 4 and 5. First, as shown in FIG. 4, the hemispherical lens 10 is thermally fused with the supporting section 1*b* with frit glass 30 therebetween, thus preparing the bulb body 1*a*. Also prepared is a detector body 12 in which the electron multiplying section 6, anode 7, and the like held between a pair of the insulator substrates 2*a* and 2*b* are secured to a stem 11 as each lead pin 60 is welded to its corresponding stem pin 110. Then, the detector body 12 is inserted into the bulb body 1*a* from its lower end opening portion 1*e*. After the bulb body 1*a* is seated on the stem 11, they are fused together. Thereafter, in the state where the inside of the envelope 1 is vacuumed in the direction of arrow B through a tube 13, an appropriate amount of an alkali metal is supplied from the tube 13, so as to effect an alkali reaction on Sb which has been deposited on the electron plate 5 beforehand, thus forming the photocathode 9 with a predetermined area. Thereafter, the tube 13 is collapsed, and an unnecessary part of the tube 13 is cut off.

Figure 5:
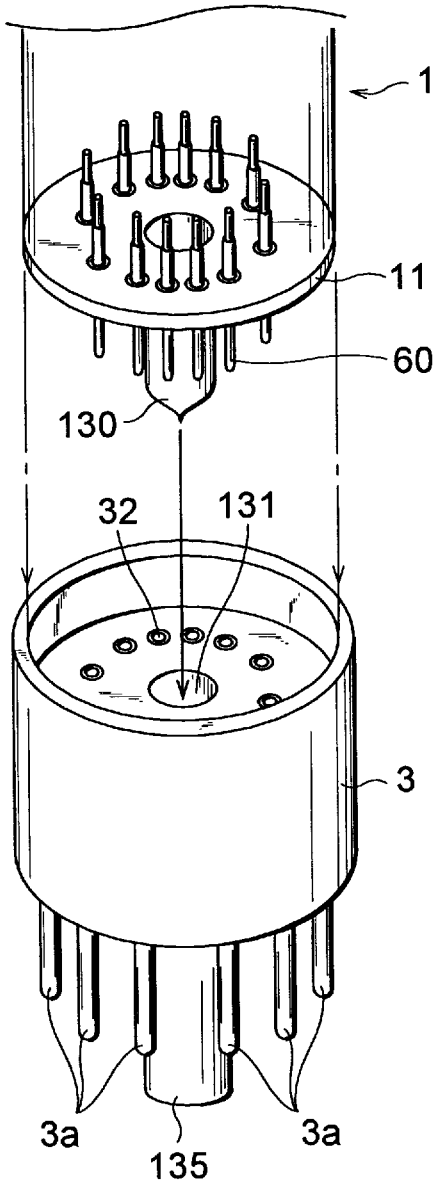
FIG. 5 is a (second) view showing an assembling step of the side-on type photomultiplier according to the present invention.
Figure 6:
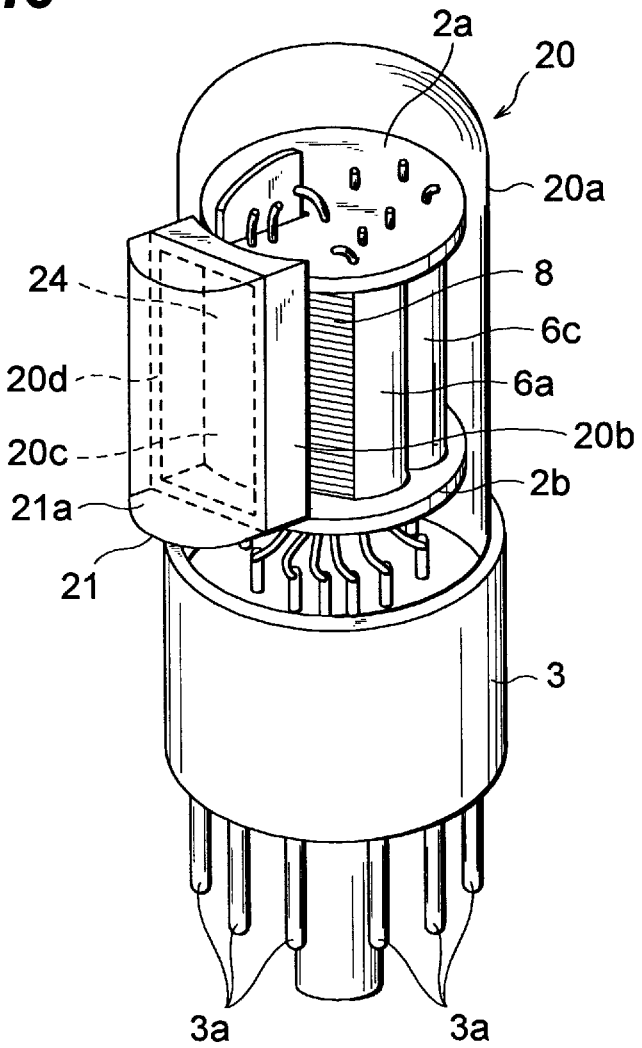
FIG. 6 is a perspective view showing an arrangement of a second embodiment of the side-on type photomultiplier in accordance with the present invention.

Subsequently, as shown in FIG. 5, the sealed envelope 1 is attached to the pin base 3. At this moment, the remaining part 130 of the tube 13 is received within an inner space 131 of a protruded portion 135 attached to the pin base 3, whereby the stem pins 60 extending from the inside of the envelope 1 to the outside are electrically connected to their corresponding base pins 3*a*.

The present invention should not be restricted to the first embodiment mentioned above. For example, a bulb body 20*a* shown in FIG. 6 (second embodiment) has a cylindrical form and comprises borosilicate glass, UV glass, silica glass, or the like. A supporting section 20*b* in a rectangular table form is integrally formed with an entrance opening 24 of the bulb body 20*a*, thereby defining a rectangular space 20 (for transmitting therethrough the light to be detected). A cylindrical lens 21, as a condenser lens, is secured to a reference surface 20*d* of the supporting section 20*b* so as to cover the entire opening of the bulb body 20*a*. The cylindrical lens 21 is made of a material different from that of the envelope 20 and is thermally fused, by means of the bonding material 30 such as frit glass, with the reference surface 20*d*, so as to be integrated with the bulb body 20*a*, thus constituting a part of the bulb body 20*a*.

Figure 7:
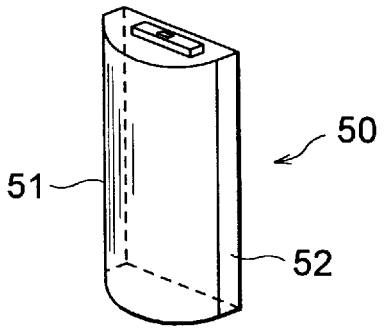
FIG. 7 is a perspective view showing a lens element which is made of a plastic material and applicable to the side-on type photomultiplier shown in FIG. 6.

Here, the condenser lens may be a cylindrical lens 50 obtained by injection molding as shown in FIG. 7. This cylindrical lens 50 has side-cut surfaces 51 and 52 formed by cutting both sides of the cylindrical lens 50.

As with the first embodiment shown in FIG. 2, the radius of curvature of a cylindrically-curved light entrance surface 21*a* disposed on the front side of the cylindrical lens 21 is selected such that the light to be detected incident on the cylindrical lens 21 substantially forms a focal point in the effective region A of the photocathode 9. The surface opposite to the entrance surface 21*a* (i.e., surface facing the photocathode 9) is also made flat so as to be securely attached to the reference surface 20*d* of the supporting section 20*b*. When the cylindrical lens 21 like this is utilized, the light to be detected can be collected into a slit form on the effective region A of the photocathode 9. Thus, the form of collected light on the photocathode 9 is elongated in its longitudinal direction so as to match the long form of the photocathode 9. Accordingly, when the part generating photoelectrons is formed like a long slit, the long electron multiplying region produced by each of the dynodes 6*a* to 6*i* can effectively be utilized. Also, each of the hemispherical lens 10 and the cylindrical lens 21 can guide a part of collimated light, which cannot reach the photocathode 9 by itself, to the effective region A. It indicates that an incident region D of the light to be detected is enlarged, whereby the photomultiplier can sufficiently be applied to such a use as measurement of weak light.

In the first and second embodiments, the bulb body and the condenser lens may also be made of the same material, and the entrance opening may be polygonal as well. Also, the photocathode 9 may be constituted by a semiconductor crystal.

As shown in FIG. 1, a light detecting apparatus to which the side-on type photomultiplier in accordance with the present invention is applied comprises a collimator 40 for collimating the light to be detected in order to sufficiently obtain the above-mentioned function of the condenser lens.

Figure 8:
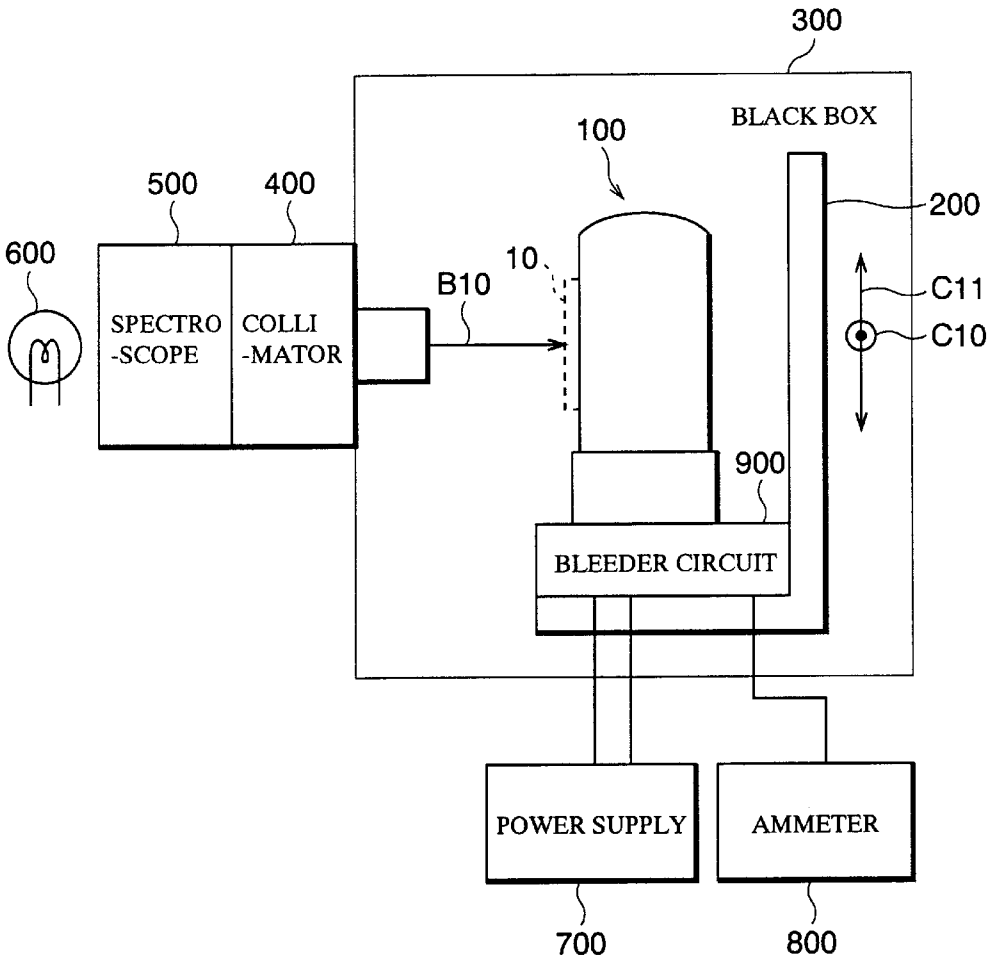
FIG. 8 is a view showing a measurement system for measuring a sensitivity characteristic of the side-on type photomultiplier according to the present invention.

FIG. 8 is a view showing a measurement system for measuring the uniformity in light receiving sensitivity of a side-on type photomultiplier which is an object to be measured.

The measurement system shown in FIG. 8 comprises, at least, a light source 600; a spectroscope 500 for selecting a light component with a predetermined wavelength from the light emitted from the light source 600; a collimator 400 for collimating the light component selected by the spectroscope 500; a black box 300 accommodating a photomultiplier 100 (including photomultipliers with and without the lens element 10) which is the object to be measured; a stage 200 for relatively moving the object to be measured with respect to a beam B10 emitted from the collimator 400; a power supply 700 for supplying a desired voltage to the object to be measured 100; a bleeder circuit 900 for dividing the voltage supplied from the power supply 700; and an ammeter 800 for detecting the output signals obtained from the anode of the object to be measured 100.

Here, the stage 200 on which the object to be measured 100 is mounted and the bleeder circuit 900 are accommodated in the black box 300. The stage 200 moves the object to be measured 100 in the directions indicated by depicted arrows C10 (directions perpendicular to the paper surface) and in the directions indicated by depicted arrows C11 (directions orthogonal to the directions indicated by C10).

Figure 9:
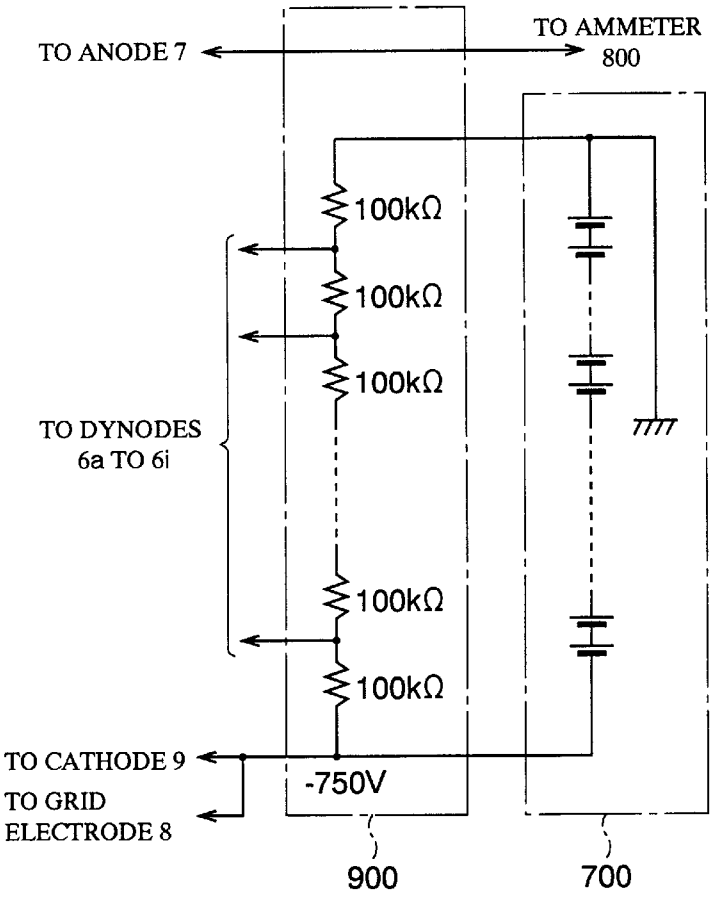
FIG. 9 is a view showing a configuration of a bleeder circuit and power supply in the measurement system of FIG. 8.

As shown in FIG. 9, the bleeder circuit 900 comprises a plurality of resistors connected in series, thereby dividing the voltage supplied from the power supply 700.

Here, the above-mentioned effective region A is, in the whole surface of the photocathode 9, not only an area which has a high sensitivity but also an area where stray electrons are hard to occur. This effective region A is an area which is near the dynode 6*a* of the first stage, is positioned near the center axis side of the envelope 1, and is far from the grid electrode 8 having the same potential. Namely, as can also be seen from FIGS. 2 and 3, the effective region A refers to, in the photocathode 9, an area which extends from near the center portion toward the dynode 6*a* of the first stage and where the light receiving sensitivity (anode output) in the width directions (directions indicated by arrows C10 in FIG. 8) is not lower than 80%. Here, there are also cases where the effective area A is determined as an area in which the light receiving sensitivity in the width directions (C10) is not lower than 90%.

Since the place for generating each photoelectron is restricted to a narrow area referred to as the effective region A, there is little deviation among times at which individual photoelectrons are generated. Also, since the photoelectrons are generated at places close to each other, fluctuation in electron transit time can be made very small. Further, even when the position of the light source fluctuates to a certain extent, thereby somewhat changing the position of light incident on the condenser lens, since the light is collected at the effective region A for photoelectrons, in combination with little fluctuation in electron transit time, the output from the anode fluctuates very little. Moreover, light can be collected at an appropriate position of the photocathode 9 due to the condensing action of the condenser lens, thereby, in combination with the above-mentioned positioning structure, facilitating the optical axis alignment of the object to be measured with the photocathode. Thus, a small shift in the optical axis hardly affects the uniformity in light receiving sensitivity. Such a condensing action is effective, in particular, for weak light such as chemiluminescence, bioluminescence, or fluorescence, thereby contributing to improvement in S/N. Besides, since the photomultiplier in accordance with the present invention has the envelope in which the bulb body and the condenser lens are integrated with each other, operations for making a product are easy to perform. Namely, an envelope with a condenser lens is prepared beforehand, an electron multiplying section and the like are attached thereto, and then the inside of the envelope is vacuumed, whereby the product can easily be made.

The inventors measured changes in light receiving sensitivity between photomultipliers with and without a condenser lens by using the measurement system shown in FIGS. 8 and 9.

Specifically, the wavelength of the light to be detected was 400 nm, whereas its spot diameter was 1 mm. The condenser lens used was a cylindrical lens having a width of 15 mm (in the directions indicated by C10 in FIG. 8) and a length of 28 mm (in the directions indicated by C11 in FIG. 8). Here, the radius of curvature of the light entrance surface 10*b* was designed such that the collimated light to be measured could reach into the effective region A.

The scanning pitch of the spot light (having a wavelength of 400 nm and a spot diameter of 1 mm) in the width directions C10 was 1 mm. On the other hand, the scanning pitch of the spot light (having a wavelength of 400 nm and a spot diameter of 1 mm) in the length directions C11 was also 1 mm. By connecting a plurality of 100-kΩ resistors in series, the bleeder circuit 900 equally divided the applied voltage. An output terminal of the anode 7 is electrically connected to the ammeter 800, whereas a voltage of −750 V was applied to the photocathode 9 and the grid electrode 8.

Figure 10:
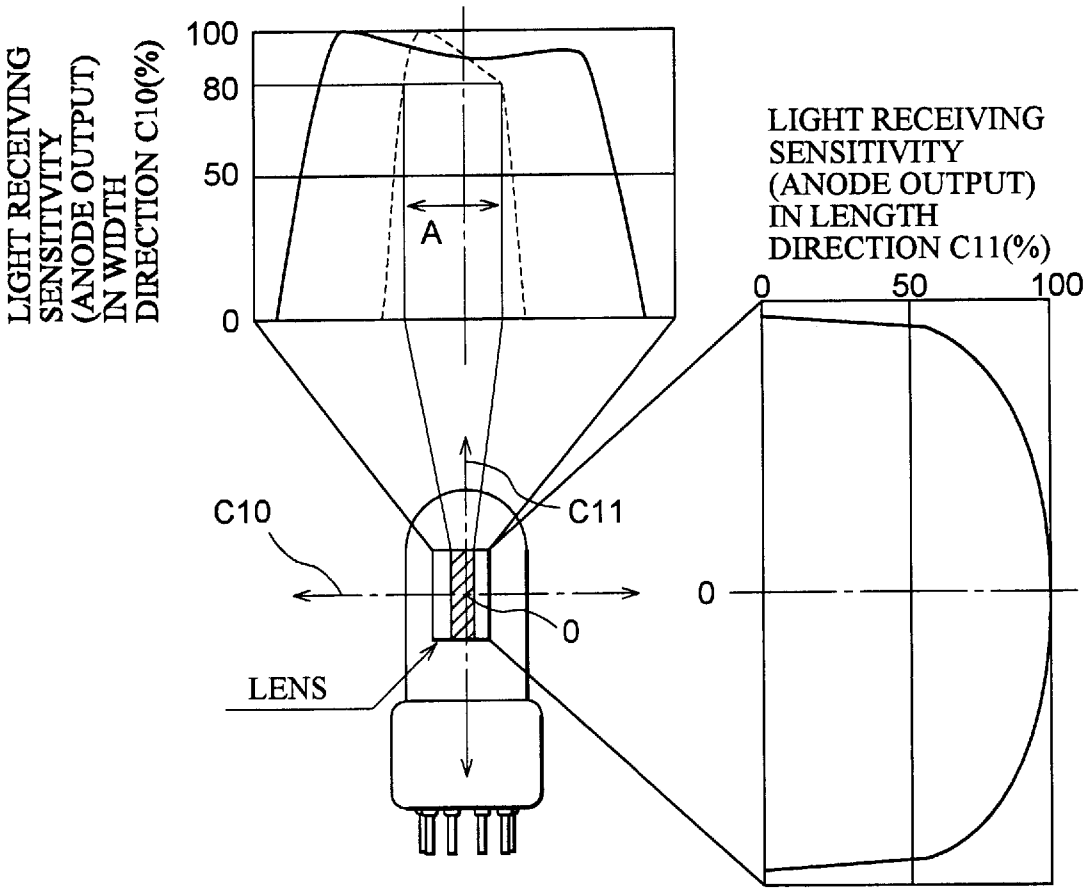
FIG. 10 is a graph showing respective anode outputs of side-on type photomultipliers with and without a lens element measured by the measurement system shown in FIG. 8.

FIG. 10 includes graphs each showing a relationship between the incident position of the spot light (with a spot diameter of 1 mm) and the anode output measured under the condition mentioned above. In these graphs, solid and dashed lines respectively indicate measured results of the photomultipliers with and without the condenser lens.

As can be seen from the upper-side graph in FIG. 10, the photomultiplier without the condenser lens can hardly measure the light to be detected incident on the outside of the effective region A. In the photomultiplier with the condenser lens, by contrast, a wide range of the light to be detected is guided by the condenser lens along the width directions C10 into the effective region A, thereby improving the uniformity in light receiving sensitivity.

On the other hand, as can be seen from the right-side graph in FIG. 10, due to the forms of the photocathode 9 and dynodes 6*a* to 6*i*, no remarkable difference could be found in the light receiving sensitivity along the length directions C11 between the cases with and without the condenser lens.

As explained in the foregoing, in accordance with the present invention, an envelope is provided beforehand with a positioning structure for placing a condenser lens at a desired position. Accordingly, the condenser lens can be precisely disposed at a position where the incident light can be condensed onto, of the photocathode, the effective region having a high sensitivity, whereby a side-on type photomultiplier with a high versatility and a high uniformity in light receiving sensitivity can be realized. Also worthy of special mention in the photomultiplier integrated with a lens according to the present invention are effects that uniformity in light receiving sensitivity is remarkably improved as compared with the conventional side-on type photomultipliers.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 8-237020 (237020/1996) filed on Sep. 6, 1996 is hereby incorporated by reference.

What is claimed is:

1. A side-on type photomultiplier comprising:

an envelope having an opening for transmitting therethrough light to be detected;

a photocathode for emitting photoelectrons in response to said light to be detected reaching said photocathode after being transmitted through the opening of said envelope, said photocathode having a light receiving surface with a predetermined area, said photocathode being accommodated in said envelope and supported by an electrode member so as to be inclined with respect to a direction of incidence of said light to be detected;

a lens element for guiding onto a predetermined region in said photocathode said light to be detected, said lens element covering the opening of said envelope so as to constitute a part of said envelope; and a positioning structure for defining an installed position of said lens element, said positioning structure having a supporting section which is provided on an outer peripheral surface of said envelope so as to surround the opening of said envelope and extending from the outer peripheral surface of said envelope along a direction opposite to the direction of incidence of said light to be detected, said supporting section including a reference surface for supporting said lens element and for defining a distance between said lens element and said photocathode.

2. A side-on type photomultiplier according to claim 1, wherein said lens element has a positive refracting power.

3. A side-on type photomultiplier according to claim 1, wherein said lens element restricts an area of a light incident region on said photocathode, where said light to be detected is to reach, such that said area becomes smaller than the area of the light receiving surface of said photocathode.

4. A side-on type photomultiplier according to claim 1, wherein said lens element includes a cylindrical lens.

5. A side-on type photomultiplier according to claim 1, wherein said lens element includes a hemispherical lens.

6. A side-on type photomultiplier according to claim 2, wherein said lens element has, at least, a flat surface facing the reference surface of said supporting section in said positioning structure.

7. A light detecting apparatus comprising:

a side-on type photomultiplier according to claim 1; and a collimator for collimating light to be detected which is to be made incident on said side-on type photomultiplier.

* * * * *